US010434779B2

(12) United States Patent
Nakamura et al.

(10) Patent No.: US 10,434,779 B2
(45) Date of Patent: Oct. 8, 2019

(54) LIQUID EJECTING APPARATUS

(71) Applicant: SEIKO EPSON CORPORATION, Tokyo (JP)

(72) Inventors: Hiroyuki Nakamura, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/901,694

(22) Filed: Feb. 21, 2018

(65) Prior Publication Data

US 2018/0244046 A1 Aug. 30, 2018

(30) Foreign Application Priority Data

Feb. 24, 2017 (JP) ..... 2017-033043

(51) Int. Cl.

| | |
|---|---|
| ***B41J 2/165*** | (2006.01) |
| ***B41J 2/17*** | (2006.01) |
| ***B41J 2/175*** | (2006.01) |
| ***B41J 2/18*** | (2006.01) |

(52) U.S. Cl.

CPC ..... *B41J 2/16523* (2013.01); *B41J 2/16526* (2013.01); *B41J 2/16535* (2013.01); *B41J 2/175* (2013.01); *B41J 2/1707* (2013.01); *B41J 2/17566* (2013.01); *B41J 2/17596* (2013.01); *B41J 2/18* (2013.01)

(58) Field of Classification Search

CPC .. B41J 2/16523; B41J 2/16535; B41J 2/1707; B41J 2/175; B41J 2/17566; B41J 2/17596; B41J 2/18; B41J 2/19

See application file for complete search history.

(56) References Cited

U.S. PATENT DOCUMENTS

| | | | | |
|---|---|---|---|---|
| 2009/0278887 | A1 | 11/2009 | Iwasaki | |
| 2010/0073444 | A1* | 3/2010 | Sato | 347/90 |
| 2010/0194798 | A1* | 8/2010 | Asami et al. | 347/7 |
| 2014/0300672 | A1* | 10/2014 | Tsukamoto | 347/89 |

FOREIGN PATENT DOCUMENTS

| | | |
|---|---|---|
| JP | 2009-269361 A | 11/2009 |
| JP | 2010-076206 A | 4/2010 |

* cited by examiner

*Primary Examiner* — Juanita D Jackson

(74) *Attorney, Agent, or Firm* — Workman Nydegger

(57) ABSTRACT

A liquid ejecting apparatus includes: a liquid ejecting head that ejects liquid; a first tank that stores the liquid to be supplied to the liquid ejecting head; a second tank that receives the liquid that was not ejected from the liquid ejecting head; circulation paths through which the liquid circulates among the first tank, the liquid ejecting head, and the second tank; a pump that feeds the liquid from the second tank to the first tank; a first supply flow path that communicates between the first tank and a first main tank that is located above the first tank and stores the liquid; a second supply flow path that communicates between the first main tank and the second tank; a first opening/closing valve that can open and close the first supply flow path; and a second opening/closing valve that can open and close the second supply flow path.

9 Claims, 6 Drawing Sheets

LIQUID EJECTING APPARATUS

BACKGROUND

1. Technical Field

The present invention relates to liquid ejecting apparatuses.

2. Related Art

An ink jet printer (hereinbelow, also simply referred to as a printer) prints an image on a medium by discharging ink from nozzles formed in a liquid ejecting head. In the liquid ejecting head, a slight negative pressure is produced to form ink meniscus in the nozzles, and, by generating a predetermined pressure in a pressure section, the ink is ejected from the nozzles.

In the liquid ejecting head, the meniscus may be broken due to attachment of foreign matter to the nozzles or due to entrance of bubbles into the nozzles. In that case, the meniscus is formed again through maintenance operations including an operation called "pressure purging", in which a positive pressure is applied to a pressure chamber to force the ink out of the nozzles, thereby removing the foreign matter or the bubbles, and an operation called "wiping", in which the ink residing on a nozzle surface is wiped off.

JP-A-2009-269361 discloses an example of the thus-configured printer, which performs a so-called pressure wiping, in which, for example, the timing of closing an pressure release valve of a sub tank located above nozzles and the timing of closing an pressure release valve of a sub tank located below the nozzles are differentiated to apply a slight positive pressure to the nozzles, thereby making the ink flow out to allow wiping.

However, because the above-described printer has a pressure pump for discharging the ink from the nozzles by applying pressure, the mechanism thereof is complicated. Furthermore, it requires complicated control, such as changing the timing of closing the pressure release valves of the sub tanks during the pressure wiping, which may make it difficult to maintain stable head discharging.

SUMMARY

An advantage of some aspects of the invention is to provide a liquid ejecting apparatus in which stable head discharging can be easily maintained.

A liquid ejecting apparatus according to an aspect of the invention includes: a liquid ejecting head that ejects liquid from nozzles onto a medium; a first tank that is located above the liquid ejecting head and stores the liquid to be supplied to the liquid ejecting head; a second tank that is located below the liquid ejecting head and receives the liquid that was not ejected from the liquid ejecting head; circulation paths through which the liquid circulates among the first tank, the liquid ejecting head, and the second tank; a pump that feeds the liquid from the second tank to the first tank; a first supply flow path that communicates between the first tank and a first main tank that is located above the first tank and stores the liquid; a second supply flow path that communicates between the first main tank and the second tank; a first opening/closing valve that can open and close the first supply flow path; and a second opening/closing valve that can open and close the second supply flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the attached drawings. Note that the components denoted by the same reference sign have the same or similar configuration throughout the drawings.

Embodiments of a liquid ejecting apparatus 1 will be described below with reference to the drawings.

First Embodiment

Figure 1:
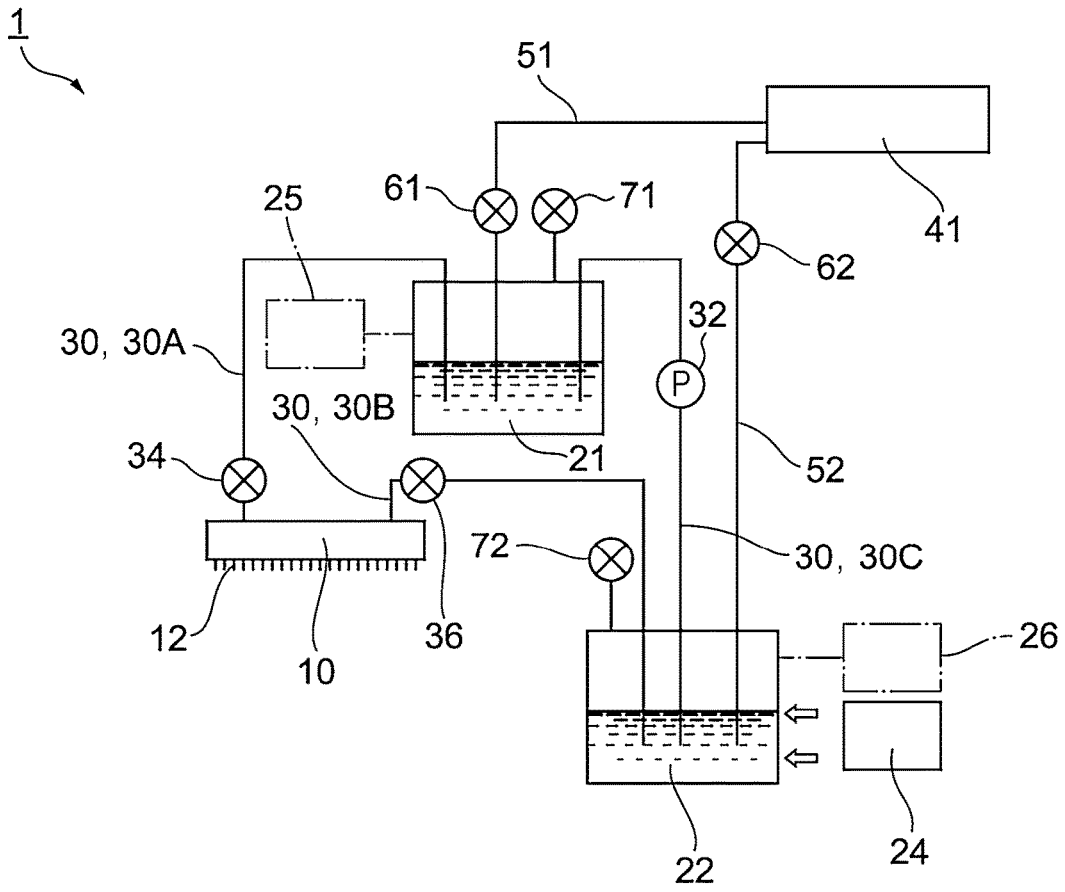
FIG. 1 shows the configuration of a liquid ejecting apparatus according to a first embodiment of the invention.

The liquid ejecting apparatus 1 according to this embodiment includes a liquid ejecting head 10, nozzles 12, a first tank 21, a second tank 22, a liquid-level detector 24, circulation paths 30, a pump 32, a first main tank 41, a first supply flow path 51, a second supply flow path 52, a first opening/closing valve 61, a second opening/closing valve 62, a first pressure release valve 71, and a second pressure release valve 72 (see FIG. 1).

The liquid ejecting head 10 is connected to the first tank 21 on the upstream side thereof and to the second tank 22 on the downstream side thereof via the circulation paths 30. The liquid ejecting head 10 ejects a predetermined amount of ink onto a medium, such as printing paper, from the nozzles 12 at predetermined timing. The liquid ejecting head 10 is located vertically below the first tank 21 and vertically above the second tank 22 (see FIG. 1).

The first tank 21 stores the ink to be supplied to the liquid ejecting head 10. The first tank 21 is connected to the first main tank 41 via the first supply flow path 51 and to the liquid ejecting head 10 and the second tank 22 via the circulation paths 30. The first tank 21 is located vertically above the second tank 22. The first tank 21 is provided with the first pressure release valve 71 that controls the air-open condition of the first tank 21.

The second tank 22 receives the ink that was not ejected from the liquid ejecting head 10. The second tank 22 is connected to the first main tank 41 via the second supply flow path 52 and to the liquid ejecting head 10 and the first tank 21 via the circulation paths 30. The second tank 22 is located vertically below the first tank 21. The second tank 22 is provided with the second pressure release valve 72 that controls the air-open condition of the second tank 22.

The liquid-level detector 24 includes a device that detects the liquid level of the ink in the second tank 22. It is also desirable to provide another liquid-level detector in the first tank 21 and to supply the ink from the second tank 22 to the first tank 21 according to the detection result. This configuration enables more appropriate control of the liquid levels of the two tanks 21 and 22. It is also possible to supply the ink from the first main tank 41 to the first tank 21.

The circulation paths 30 allow the ink to circulate among the first tank 21, the liquid ejecting head 10, and the second tank 22. In the circulation paths 30, a part (a first path 30A) between the first tank 21 and the liquid ejecting head 10 is provided with an opening/closing valve 34, and a part (a second path 30B) between the liquid ejecting head 10 and the second tank 22 is provided with an opening/closing valve 36.

The pump 32 feeds the ink from the second tank 22 to the first tank 21 and is provided in a part (a third path 30C) between the second tank 22 and the first tank 21 in the circulation paths 30.

The first main tank 41 stores the ink and is located vertically above the first tank 21. The first main tank 41 communicates with the first tank 21, serving as a pressure generating section, via the first supply flow path 51 and with the second tank 22 via the second supply flow path 52. The first supply flow path 51 is provided with the first opening/closing valve 61, which is, for example, a solenoid valve. The second supply flow path 52 is provided with the second opening/closing valve 62, which is, for example, a solenoid valve.

The liquid ejecting apparatus 1 also includes a control unit (not shown). The control unit receives signals from all sensors, including the liquid-level detector 24, in the liquid ejecting apparatus 1 and controls the driving sections, such as the liquid ejecting head 10, the pump 32, the opening/closing valve 34, the opening/closing valve 36, the first opening/closing valve 61, the second opening/closing valve 62, the first pressure release valve 71, and the second pressure release valve 72.

In the liquid ejecting apparatus 1 according to this embodiment, it is possible to easily switch between supplying liquid to the second tank 22, serving as a sub tank, by means of the hydraulic head difference and applying pressure to the liquid ejecting head 10 by means of the hydraulic head difference. Specifically, when the second opening/closing valve 62 is open, it is possible to supply the ink from the first main tank 41 to the second tank 22 by means of the hydraulic head difference, and when, for example, the first opening/closing valve 61 is open and the first pressure release valve 71 is closed, it is possible to apply pressure to the inside of the first tank 21 by means of the hydraulic head difference and thus to supply the ink to the liquid ejecting head 10. This switching can be easily performed only by opening or closing the first opening/closing valve 61, the second opening/closing valve 62, etc.

In the liquid ejecting apparatus 1 according to this embodiment, by opening the first opening/closing valve 61 with the second opening/closing valve 62 is closed, it is possible to discharge the ink from the nozzles 12. According to this aspect, by using application of pressure to the liquid ejecting head 10 by means of the hydraulic head difference, it is possible to easily discharge the ink from the discharging nozzles 12 by pressure.

Furthermore, in the liquid ejecting apparatus 1 according to this embodiment, it is also possible to discharge the ink from the nozzles 12 by driving the pump 32 with the first opening/closing valve 61 is closed. In this case, it is easy to apply additional pressure to the liquid ejecting head 10.

Furthermore, in the liquid ejecting apparatus 1 according to this embodiment, when the liquid-level detector 24 detects that the ink height in the second tank 22 has dropped below a predetermined height, the ink may be supplied from the first main tank 41 to the second tank 22 by closing the first opening/closing valve 61 and opening the second opening/closing valve 62. By doing so, it is possible to supply the ink from the first main tank 41 to the second tank 22 at more appropriate timing.

Furthermore, in the liquid ejecting apparatus 1 according to this embodiment, when the liquid ejecting head 10 ejects the ink onto a medium, the ink may be circulated by driving the pump 32 with the first pressure release valve 71 is opened and the second pressure release valve 72 is closed. By circulating the ink with the second pressure release valve 72 is closed in this way, it is possible to produce an appropriate negative pressure in the second tank 22.

In the liquid ejecting apparatus 1 according to this embodiment, by making the flow path resistance of the first path 30A higher than the flow path resistance of the second path 30B, a negative pressure due to circulation may be applied to the nozzles 12. In this case, it is desirable to circulate the ink with both the first pressure release valve 71 and the second pressure release valve 72 is opened. In this case, there is no need to produce a negative pressure in the second tank 22, and thus, it is possible to immediately supply the ink.

Alternatively, the pressure-discharging method in the liquid ejecting apparatus 1 may be selected from below:

(1) Applying pressure to the liquid ejecting head 10 from the first main tank 41 via the first tank 21 by means of the hydraulic head difference. The pressure application like this is suitable for pressure wiping.

(2) Combining liquid supply from the first main tank 41 to the second tank 22 by means of the hydraulic head difference and driving of the pump 32. The pressure discharging like this is suitable for pressure filling, in which the flow path is filled with the liquid, and pressure purging.

Furthermore, the liquid ejecting apparatus 1 may also have opening/closing valves in the circulation path 30 (first path 30A) extending from the first tank 21 to the liquid ejecting head 10 and in the circulation path 30 (second path 30B) extending from the liquid ejecting head 10 to the second tank 22. In the liquid ejecting apparatus 1 according to this embodiment having the opening/closing valves 34 and 36, when the ink is discharged from the nozzles 12 by pressure, it is desirable to apply pressure with the opening/closing valve 34 in the circulation path 30 (first path 30A) extending from the first tank 21 to the liquid ejecting head 10 open and the opening/closing valve 36 in the circulation path 30 (second path 30B) extending from the liquid ejecting head 10 to the second tank 22 closed. By doing so, it is possible to apply pressure only to the nozzles 12.

Furthermore, to increase the flow rate of the ink discharged from the nozzles 12, the opening/closing valve 34 in the circulation path 30 (first path 30A) extending from the first tank 21 to the liquid ejecting head 10 may be closed to accumulate the pressure, and then, the opening/closing valve 34 may be opened to discharge the ink from the nozzles 12.

Second Embodiment

Figure 2:
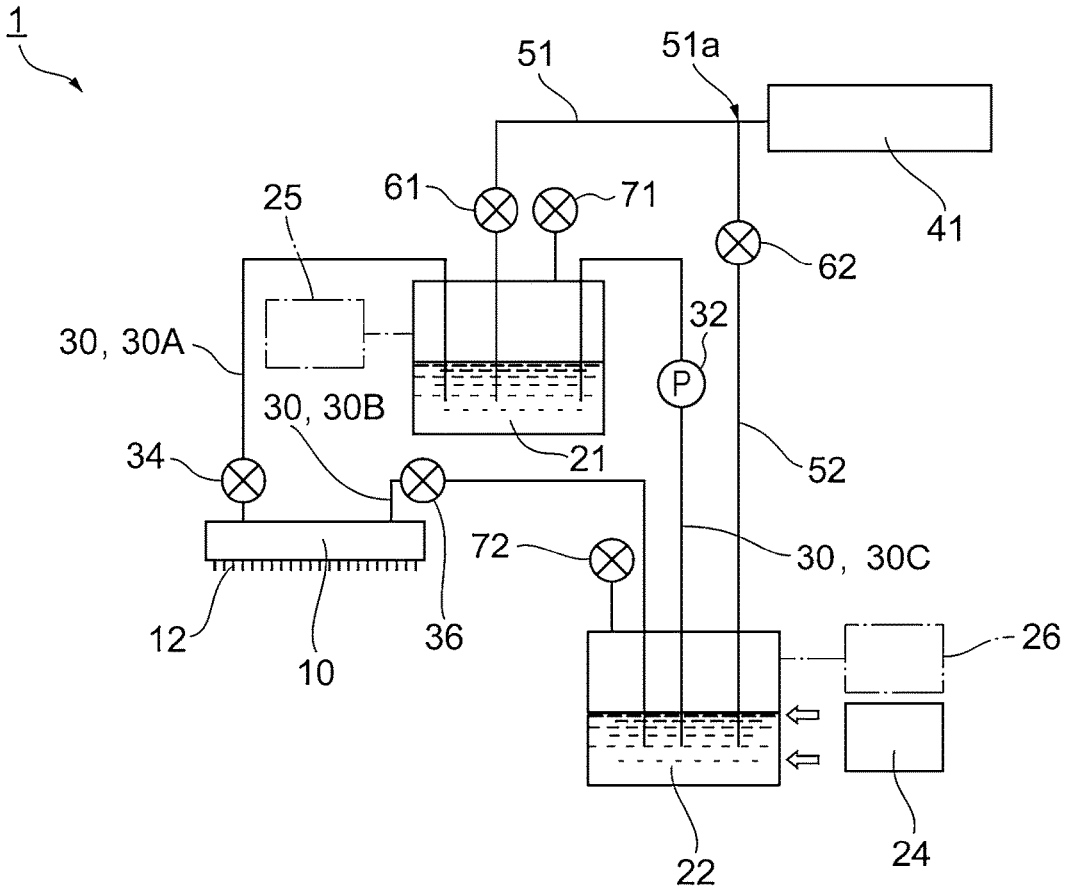
FIG. 2 shows the configuration of a liquid ejecting apparatus according to a second embodiment of the invention.

In the liquid ejecting apparatus 1, the second supply flow path 52 may branch off from the first supply flow path 51, or the first supply flow path 51 may branch off from the second supply flow path 52. In the liquid ejecting apparatus 1 according to this embodiment, the second supply flow path 52 branches off from the first supply flow path 51 at a branching portion 51*a* and communicates with the second tank 22 (see FIG. 2).

In the liquid ejecting apparatus 1 according to this embodiment, a portion of the first supply flow path 51 or a portion of the second supply flow path 52 may be shared by the other.

Third Embodiment

Figure 3:
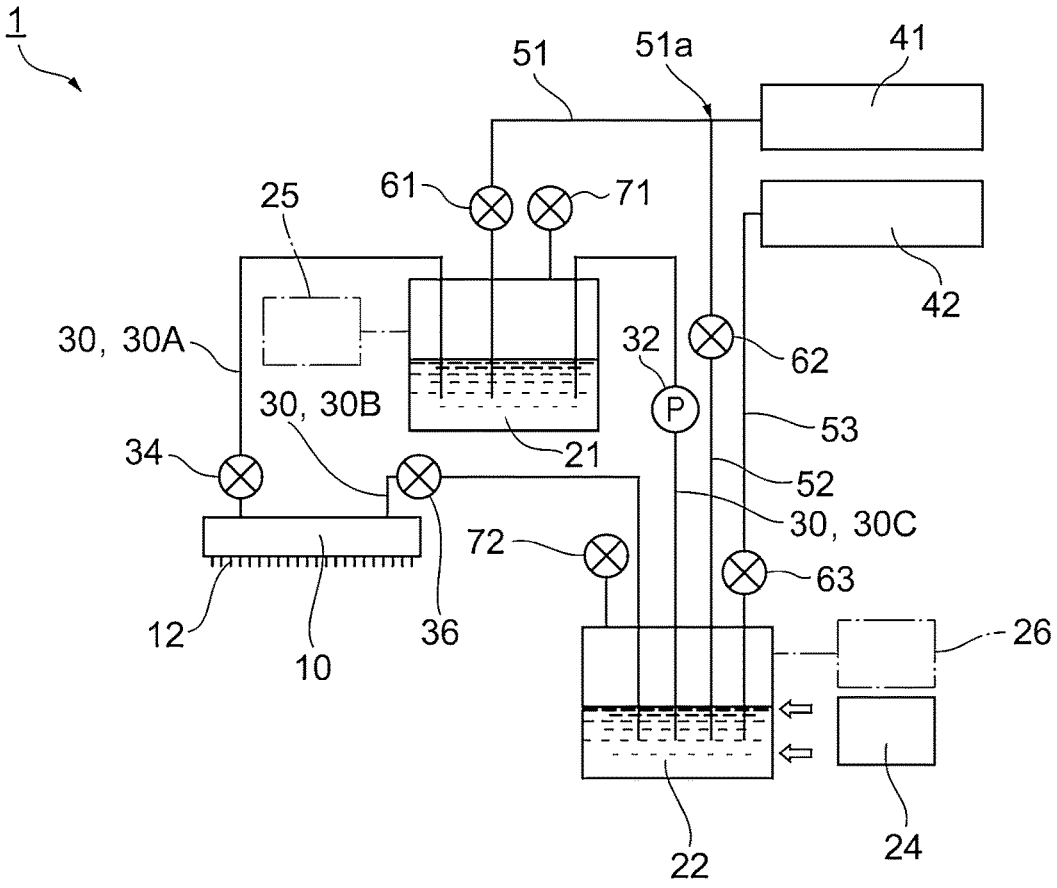
FIG. 3 shows the configuration of a liquid ejecting apparatus according to a third embodiment of the invention.

The liquid ejecting apparatus 1 according to this embodiment includes, besides the configuration of the second embodiment, a second main tank 42, a third supply flow path 53, and a third opening/closing valve 63 (see FIG. 3).

The second main tank 42 is located vertically above the second tank 22 and supplies the ink stored therein to the second tank 22. The third supply flow path 53 connecting the second main tank 42 and the second tank 22 is provided with the third opening/closing valve 63.

In this liquid ejecting apparatus 1, by opening at least one of the second opening/closing valve 62 and the third opening/closing valve 63 with the first opening/closing valve 61 is closed, it is possible to supply the ink to the second tank 22 from at least one of the first main tank 41 and the second main tank 42. Furthermore, in the liquid ejecting apparatus 1 according to this embodiment, it is possible to simultaneously supply the ink to the second tank 22 from a plurality of main tanks, namely, the first main tank 41 and the second main tank 42. This increases the printing speed of the printer.

In this embodiment, when the liquid-level decreasing speed is high, the ink may be simultaneously supplied from the plurality of main tanks, namely, the first main tank 41 and the second main tank 42, and, when the liquid-level decreasing speed is low, the ink may be supplied from one of the main tanks. This enables the supply of ink according to the printing speed.

Fourth Embodiment

Figure 4:
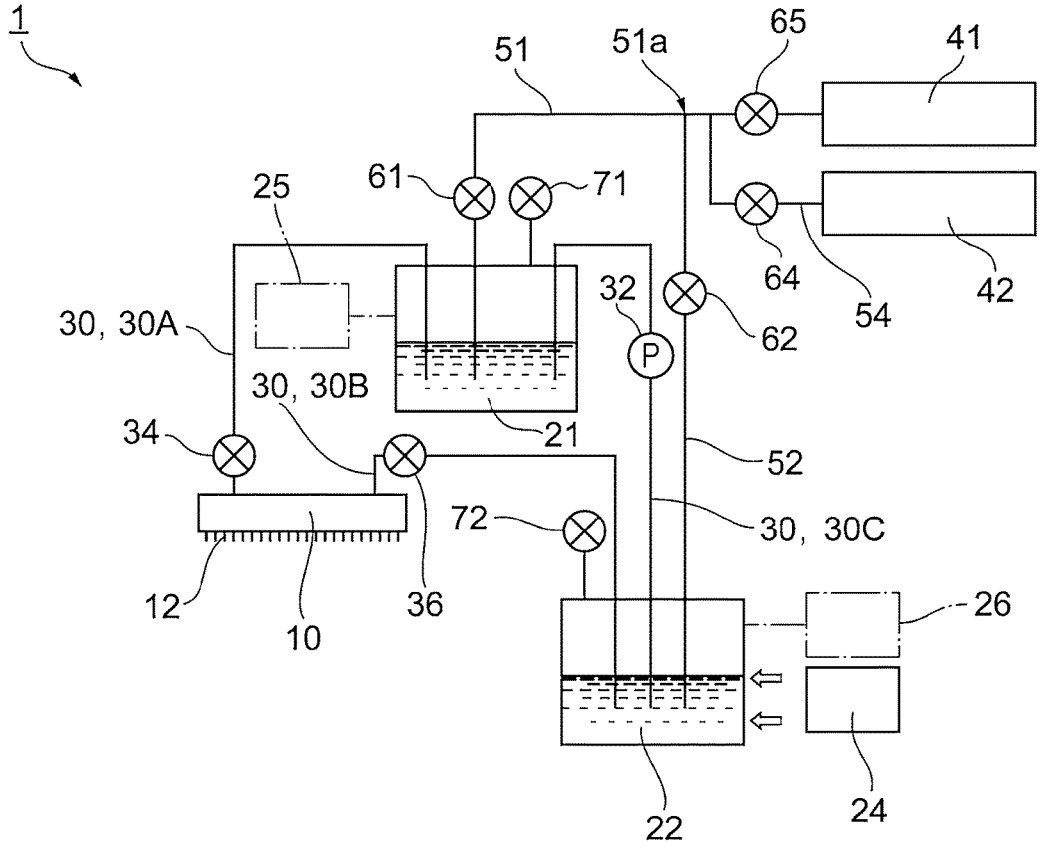
FIG. 4 shows the configuration of a liquid ejecting apparatus according to a fourth embodiment of the invention.

The liquid ejecting apparatus 1 according to this embodiment includes, besides the configuration of the second embodiment, a fourth supply flow path 54, a fourth opening/closing valve 64, and a fifth opening/closing valve 65 (see FIG. 4).

The fourth supply flow path 54 connects the second main tank 42 and a portion of the first supply flow path 51 upstream of the branching portion 51*a*. The fourth supply flow path 54 is provided with the fourth opening/closing valve 64. Furthermore, a flow path of the first supply flow path 51 upstream of the branching portion 51*a* is provided with the fifth opening/closing valve 65.

In this liquid ejecting apparatus 1, by opening the second opening/closing valve 62 and at least one of the fourth opening/closing valve 64 and the fifth opening/closing valve 65 with the first opening/closing valve 61 is closed, it is possible to supply the ink to the second tank 22 from at least one of the first main tank 41 and the second main tank 42. Furthermore, in this liquid ejecting apparatus 1, even when one of the first main tank 41 and the second main tank 42 has used up all the liquid (i.e., an ink end state), it is possible to close the opening/closing valve corresponding to that main tank and to supply the ink from the other main tank. Hence, the main tank in an ink end state can be replaced even during printing.

In this embodiment, when one of the first main tank 41 and the second main tank 42 is an ink end state, the opening/closing valve corresponding to that main tank may be closed to supply the ink only from the other main tank. This enables the main tank in an ink end state to be replaced even during printing.

Furthermore, in the liquid ejecting apparatus 1 according to the third and fourth embodiments, when a configuration in which pressure discharging by means of the hydraulic head difference between the main tanks 41 and 42 is not performed is employed, configurations of the first and second modifications below may be employed.

First Modification

Figure 5:
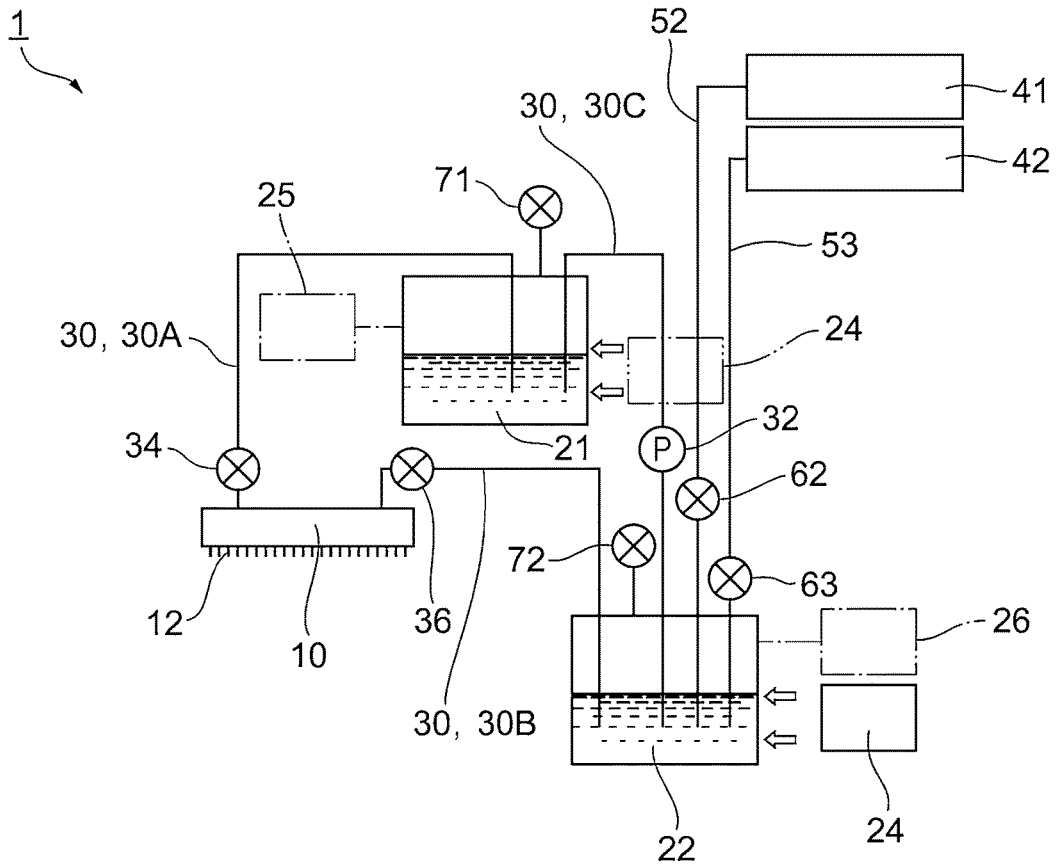
FIG. 5 shows the configuration of a liquid ejecting apparatus according to a first modification.

The liquid ejecting apparatus 1 according to this modification has a configuration similar to the configuration of the third embodiment, but without the first opening/closing valve 61 or the portion of the first supply flow path 51 communicating with the first tank 21 (see FIG. 5). In this modification, when the liquid-level decreasing speed is high, the ink may be simultaneously supplied from a plurality of main tanks, and when the liquid-level decreasing speed is low, the ink may be supplied from one of the main tanks. This enables high-speed supply of ink according to the printing speed.

Second Modification

Figure 6:
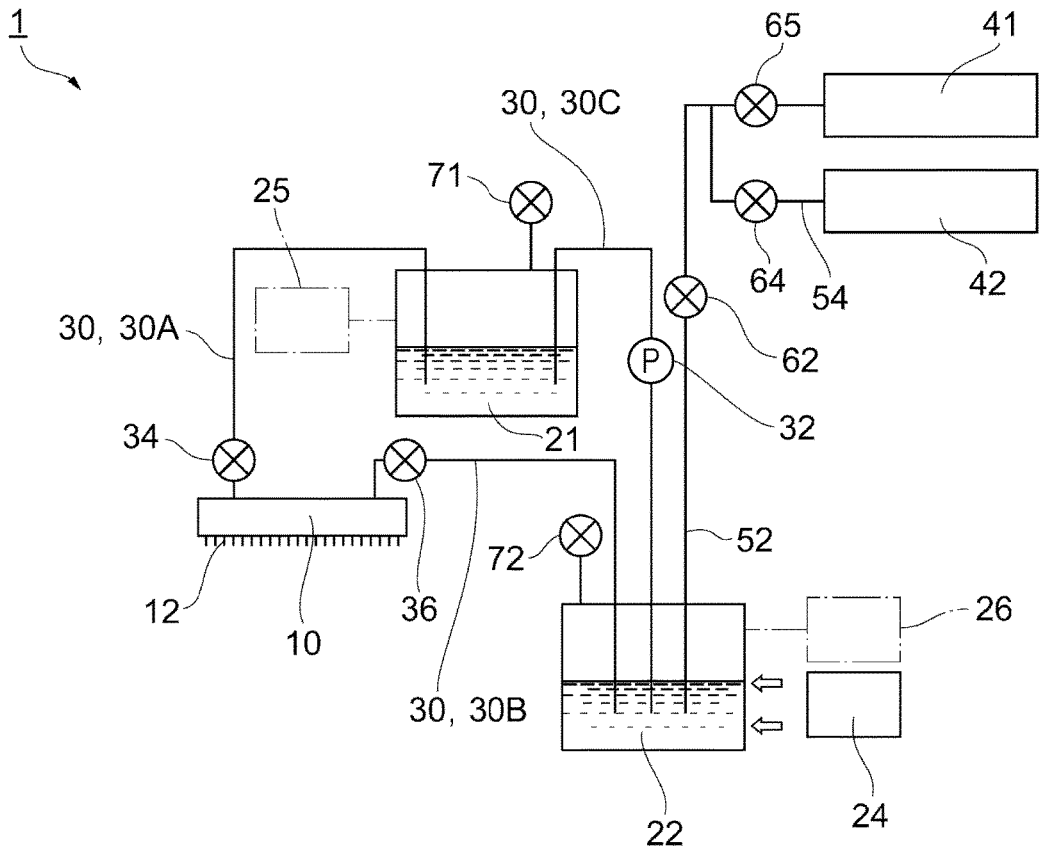
FIG. 6 shows the configuration of a liquid ejecting apparatus according to a second modification.

The liquid ejecting apparatus 1 according to this modification has a configuration similar to the configuration of the fourth embodiment, but without the first opening/closing valve 61 or the portion of the first supply flow path 51 between the branching portion 51*a* and the first tank 21 (see FIG. 6). In this modification, when one of the main tanks is an ink end state, the opening/closing valve (the fourth opening/closing valve 64 or the fifth opening/closing valve 65) corresponding to that main tank may be closed to supply the ink only from the other main tank. Because this configuration enables replacement of the main tank in an ink end state during printing, it is possible to reduce the downtime.

The above-described embodiments are for facilitating understanding of the invention and are not for limiting the invention. The components of the embodiments, the locations thereof, the materials, the conditions, the shapes, the sizes, etc., are not limited to those explained above and may be appropriately modified. Furthermore, it is possible to partially exchange or combine the configurations shown in different embodiments.

For example, in the liquid ejecting apparatus 1 according to the respective embodiments, when the liquid-level detector 24 of the second tank 22 has not detected "liquid level Full" for a predetermined period of time while the ink is supplied from a main tank to the second tank 22 with the second opening/closing valve 62 or the third opening/closing valve 63 is opened, it is determined that this main tank is in an ink end state, and this is notified to a user. When there are a plurality of main tanks, it is possible to automatically close the opening/closing valve corresponding to the main tank that was determined to be in an ink end state and to automatically open the opening/closing valve corresponding to the other main tank to continue the supply of ink. Alternatively, it is also possible to allow the user to choose from options, such as to continue the supply of ink, to stop the operation, to replace the main tank, etc.

As shown by a one-dot chain line in FIG. 1, the liquid ejecting apparatus 1 may include a pressurizing portion 25 that applies pressure to the inside of the first tank 21 and a depressurizing portion 26 that reduces the pressure inside the second tank 22. In this liquid ejecting apparatus 1, it is desirable to circulate the ink from the first tank 21 to the second tank 22 by applying and reducing the pressure with the first pressure release valve 71 and the second pressure release valve 72 are closed and to circulate the ink from the second tank 22 to the first tank 21 with the pump 32. In that case, pressure discharging may be performed by applying pressure to the inside of the first tank 21 with the pressurizing portion 25.

Furthermore, when the liquid ejecting head 10 ejects the ink onto a medium, the pressure inside the second tank 22 is reduced by the depressurizing portion 26 with the second pressure release valve 72 is closed, and the pump 32 is driven with the first pressure release valve 71 is opened, thereby circulating the ink. By circulating the ink with the second pressure release valve 72 is closed to produce a negative pressure in the second tank 22 in this way, it is possible to produce an appropriate negative pressure in the liquid ejecting head 10.

Furthermore, in the liquid ejecting apparatus 1, it is desirable to provide a filter in the circulation paths 30. This prevents foreign matter from flowing into the liquid ejecting head 10. More than one filter may be provided.

Furthermore, in the liquid ejecting apparatus 1, an ink receiver for receiving the ink overflowing the first tank 21 or the second tank 22 may be provided below at least one of the first tank 21 and the second tank 22. In this case, (1) a flow path that communicates between the ink receiver and a waste-liquid storage section for storing waste liquid may be provided to guide the ink received by the ink receiver to the waste-liquid storage section, or (2) a leaked-ink sensor may be provided in the ink receiver to stop the supply of ink when it detects the ink. This may be notified to a user. Both (1) and (2) can suppress leakage of the ink to the outside of the apparatus.

Furthermore, in the liquid ejecting apparatus 1, the first opening/closing valve 61 to the fifth opening/closing valve 65 and the first pressure release valve 71 are desirably normally closed opening/closing valves. Because this suppresses a situation where the valves do not close when the power is OFF, it is possible to suppress leakage due to the hydraulic head difference.

Furthermore, in the liquid ejecting apparatus 1, a pressure-regulating valve that opens when the downstream side thereof reaches a predetermined negative pressure may be provided in the first path 30A of the circulation paths 30. This makes it easy to maintain a constant negative pressure in the head during circulating. In this case, a mechanism for forcedly opening the pressure-regulating valve may be provided to enable pressure discharging. It is desirable to provide a filter on the upstream side of the pressure-regulating valve.

The invention is suitable for use in liquid ejecting apparatuses.

Technical ideas and the advantages thereof understood from the above-described embodiments and modifications will be described below.

Idea 1

A liquid ejecting apparatus including:

a liquid ejecting head that ejects liquid from nozzles onto a medium;

a first tank that is located above the liquid ejecting head and stores the liquid to be supplied to the liquid ejecting head;

a second tank that is located below the liquid ejecting head and receives the liquid that was not ejected from the liquid ejecting head;

circulation paths through which the liquid circulates among the first tank, the liquid ejecting head, and the second tank;

a pump that feeds the liquid from the second tank to the first tank;

a first supply flow path that communicates between the first tank and a first main tank that is located above the first tank and stores the liquid;

a second supply flow path that communicates between the first main tank and the second tank;

a first opening/closing valve that can open and close the first supply flow path; and a second opening/closing valve that can open and close the second supply flow path.

According to Idea 1, it is possible to easily switch between supplying liquid to the second tank, serving as a sub tank, by means of the hydraulic head difference and applying pressure to the head by means of the hydraulic head difference.

Idea 2

The liquid ejecting apparatus according to Idea 1, wherein the second supply flow path braches off from the first supply flow path at a branching portion thereof and communicates with the second tank.

Idea 3

The liquid ejecting apparatus according to Ideas 1 or 2, wherein the liquid is discharged from the nozzles by opening the first opening/closing valve with the second opening/closing valve is closed.

According to Idea 3, by using application of pressure to the liquid ejecting head by means of the hydraulic head difference, it is possible to easily discharge the liquid from the nozzles by pressure.

Idea 4

The liquid ejecting apparatus according to any one of Ideas 1 to 3, wherein the liquid is discharged from the nozzles by driving the pump with the first opening/closing valve is closed.

According to Idea 4, it is possible to easily apply an additional pressure to the liquid ejecting head.

Idea 5

The liquid ejecting apparatus according to any one of Ideas 1 to 4, further including a liquid-level detector that detects the liquid level in the second tank, wherein, when the liquid-level detector detects that the liquid level in the second tank has dropped below a predetermined height, the liquid is supplied from the first main tank to the second tank by closing the first opening/closing valve and opening the second opening/closing valve.

According to Idea 5, it is possible to supply the liquid from the first main tank to the second tank at more appropriate timing.

Idea 6

The liquid ejecting apparatus according to any one of Ideas 1 to 5, further including:

a first pressure release valve that opens the first tank to the air; and a second pressure release valve that opens the second tank to the air, wherein, when the liquid ejecting head ejects the liquid to the medium, the liquid is circulated by driving the pump with the first pressure release valve is opened and the second pressure release valve is closed.

According to Idea 6, by circulating the liquid with the second pressure release valve is closed, it is possible to produce an appropriate negative pressure in the second tank.

Idea 7

The liquid ejecting apparatus according to any one of Ideas 1 to 6, further including:

a first pressure release valve that opens the first tank to the air;

a second pressure release valve that opens the second tank to the air; and a depressurizing portion that reduces the pressure inside the second tank, wherein, when the liquid ejecting head ejects the liquid to the medium, the liquid is circulated by closing the second pressure release valve and reducing the pressure inside the second tank with the depressurizing portion and by opening the first pressure release valve and driving the pump.

According to Idea 7, by circulating the liquid with the second pressure release valve is closed to make the pressure inside the second tank negative, it is possible to produce an appropriate negative pressure in the head.

Idea 8

The liquid ejecting apparatus according to any one of Ideas 1 to 7, further including:

a third supply flow path that communicates between the second tank and a second main tank storing the liquid; and a third opening/closing valve that can open and close the third supply flow path, wherein the liquid is supplied from at least one of the first main tank and the second main tank to the second tank by opening at least one of the second opening/closing valve and the third opening/closing valve with the first opening/closing valve is closed.

According to Idea 8, because the liquid can be simultaneously supplied from a plurality of main tanks to the second tank, it is possible to increase the printing speed.

Idea 9

The liquid ejecting apparatus according to Idea 2, further including:

a fourth supply flow path that communicates between the second main tank storing the liquid and a portion of the first supply flow path on the upstream side of the branching portion;

a fourth opening/closing valve that can open and close the fourth supply flow path; and a fifth opening/closing valve that can open and close the portion of the first supply flow path on the upstream side of the branching portion, wherein the liquid is supplied from at least one of the first main tank and the second main tank to the second tank by opening the second opening/closing valve and at least one of the fourth opening/closing valve and the fifth opening/closing valve with the first opening/closing valve is closed.

According to Idea 9, even when one of the main tank has used up all the liquid, it is possible to close the opening/closing valve corresponding to that main tank and to supply the liquid from the other main tank. Accordingly, the empty main tank can be replaced during printing.

The entire disclosure of Japanese Patent Application No.2017-033043, filed Feb. 24, 2017, is expressly incorporated by reference herein.

What is claimed is:

1. A liquid ejecting apparatus comprising:

a liquid ejecting head that ejects liquid from nozzles onto a medium;

a first tank that is located above the liquid ejecting head and stores the liquid to be supplied to the liquid ejecting head;

a second tank that is located below the liquid ejecting head and receives the liquid that was not ejected from the liquid ejecting head;

circulation paths through which the liquid circulates among the first tank, the liquid ejecting head, and the second tank;

a pump that feeds the liquid from the second tank to the first tank;

a first supply flow path that communicates between the first tank and a first main tank that is located above the first tank and stores the liquid;

a second supply flow path that communicates between the first main tank and the second tank;

a first opening/closing valve that can open and close the first supply flow path; and a second opening/closing valve that can open and close the second supply flow path.

2. The liquid ejecting apparatus according to claim 1, wherein the second supply flow path branches off from the first supply flow path at a branching portion thereof and communicates with the second tank.

3. The liquid ejecting apparatus according to claim 2, further comprising:

a fourth supply flow path that communicates between the second main tank storing the liquid and a portion of the first supply flow path on the upstream side of the branching portion;

a fourth opening/closing valve that can open and close the fourth supply flow path; and a fifth opening/closing valve that can open and close the portion of the first supply flow path on the upstream side of the branching portion, wherein the liquid is supplied from at least one of the first main tank and the second main tank to the second tank by opening the second opening/closing valve and at least one of the fourth opening/closing valve and the fifth opening/closing valve with the first opening/closing valve is closed.

4. The liquid ejecting apparatus according to claim 1, wherein the liquid is discharged from the nozzles by opening the first opening/closing valve with the second opening/closing valve is closed.

5. The liquid ejecting apparatus according to claim 1, wherein the liquid is discharged from the nozzles by driving the pump with the first opening/closing valve is closed.

6. The liquid ejecting apparatus according to claim 1, further comprising a liquid-level detector that detects the liquid level in the second tank, wherein, when the liquid-level detector detects that the liquid level in the second tank has dropped below a predetermined height, the liquid is supplied from the first main tank to the second tank by closing the first opening/closing valve and opening the second opening/closing valve.

7. The liquid ejecting apparatus according to claim 1, further including:

a first pressure release valve that opens the first tank to the air; and a second pressure release valve that opens the second tank to the air, wherein, when the liquid ejecting head ejects the liquid to the medium, the liquid is circulated by driving the pump with the first pressure release valve is opened and the second pressure release valve is closed.

8. The liquid ejecting apparatus according to claim 1, further comprising:

a first pressure release valve that opens the first tank to the air;

a second pressure release valve that opens the second tank to the air; and a depressurizing portion that reduces the pressure inside the second tank, wherein, when the liquid ejecting head ejects the liquid to the medium, the liquid is circulated by closing the second pressure release valve and reducing the pressure inside the second tank with the depressurizing portion and by opening the first pressure release valve and driving the pump.

9. The liquid ejecting apparatus according to claim 1, further comprising:

a third supply flow path that communicates between the second tank and a second main tank storing the liquid; and a third opening/closing valve that can open and close the third supply flow path, wherein the liquid is supplied from at least one of the first main tank and the second main tank to the second tank by opening at least one of the second opening/closing valve and the third opening/closing valve with the first opening/closing valve is closed.

* * * * *